US011976854B2

(12) United States Patent
Gorgy et al.

(10) Patent No.: US 11,976,854 B2
(45) Date of Patent: May 7, 2024

(54) ENHANCED TUBE FOR DIRECT EXPANSION EVAPORATORS

(71) Applicant: TRANE INTERNATIONAL INC., Davidson, NC (US)

(72) Inventors: Evraam I Gorgy, Onalaska, WI (US); Jon P. Hartfield, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 17/815,827

(22) Filed: Jul. 28, 2022

(65) Prior Publication Data

US 2024/0035718 A1 Feb. 1, 2024

(51) Int. Cl.

| | |
|---|---|
| ***F25B 39/00*** | (2006.01) |
| ***F25B 39/02*** | (2006.01) |
| ***F28F 1/36*** | (2006.01) |
| ***F28F 13/18*** | (2006.01) |

(52) U.S. Cl.

CPC ..... *F25B 39/00* (2013.01); *F28F 1/36* (2013.01); *F28F 13/187* (2013.01); *F25B 39/02* (2013.01); *F25B 2339/0242* (2013.01)

(58) Field of Classification Search

CPC .. F25B 39/00; F25B 39/02; F25B 2339/0242; F25B 2339/024; F28F 1/40; F28F 1/36; F28F 13/187

See application file for complete search history.

(56) References Cited

U.S. PATENT DOCUMENTS

| | | | | |
|---|---|---|---|---|
| 8,302,307 | B2 | 11/2012 | Thors et al. | |
| 8,573,022 | B2 | 11/2013 | Thors et al. | |
| 10,900,722 | B2 * | 1/2021 | Reagen | B21C 37/202 |
| 2009/0294112 | A1 * | 12/2009 | Reifel | F28F 1/40 165/182 |
| 2012/0199330 | A1 * | 8/2012 | Maurer | F28D 7/1669 165/172 |
| 2021/0348854 | A1 * | 11/2021 | He | F28F 1/12 |
| 2022/0003504 | A1 * | 1/2022 | Gupte | F28F 9/0214 |

* cited by examiner

*Primary Examiner* — Henry T Crenshaw
*Assistant Examiner* — Kamran Tavakoldavani
(74) *Attorney, Agent, or Firm* — HSML P.C.

(57) ABSTRACT

An HVACR system, a direct expansion evaporator, and a direct expansion heat exchanger tube arranged to evaporate a working fluid inside the tube are disclosed. The tube includes an exterior surface of the tube opposing an inner surface of the tube, and a cavity layer on the inner surface configured to evaporate the working fluid flowing in a first flow path arranged to direct the first fluid to flow through the tube and contact the cavity layer on the inner surface. A second flow path, separate from the first flow path, is arranged to direct a second fluid across the tube and to contact the extended member on the exterior surface of the tube such that the first fluid exchanges thermal energy with the second fluid.

18 Claims, 8 Drawing Sheets

ENHANCED TUBE FOR DIRECT EXPANSION EVAPORATORS

FIELD

This disclosure relates generally to heating, ventilation, air conditioning, and refrigeration ("HVACR") systems. More specifically, this disclosure relates to heat exchanger tubes for shell-and-tube heat exchangers in HVACR systems.

BACKGROUND

HVACR systems are generally used to heat, cool, and/or ventilate a space. One application for an HVACR system may include chiller equipment or a heat transfer circuit to provide cooling of air. Typically, the heat transfer circuit or the chiller equipment may include a compressor, an evaporator, a condenser, an expansion device, and a working fluid. The chiller can be part of a cooling system in which the evaporator cools a stream of liquid/water using the working fluid. The condenser is used to reject the heat generated in the evaporator.

For example, shell-and-tube heat exchangers are often used for the condenser and/or the evaporator of the chiller system. Heat exchanger tubes can be included in a tube bundle disposed inside the heat exchanger. The heat exchanger tubes can isolate the working fluid from the liquid and/or water being cooled. A direct expansion heat exchanger is a type of heat exchangers where the refrigerant flows inside the heat exchanger tubes and goes through phase change to cool the liquid and/or water that flows outside the heat exchanger tubes.

SUMMARY

In an embodiment, an evaporator for a refrigerant circuit is disclosed. The evaporator includes a shell including an internal volume a tube bundle extending through the internal volume. At least one tube in the tube bundle has an exterior surface and an inner surface. An extended member is on the exterior surface, and a cavity layer is on the inner surface. A first flow path is configured to direct the first fluid to flow through the tube bundle and contact the cavity layer on the inner surface of the at least one tube to evaporate the first fluid. A second flow path, separate from the first flow path, is configured to direct a second fluid across the tube bundle and to contact the extended member on the exterior surface of the at least one tube such that the first fluid exchanges thermal energy with the second fluid.

In another embodiment, the evaporator includes the first fluid is a working fluid, and the cavity layer is an enhanced boiling surface arranged to evaporate the first fluid flowing inside the at least one tube.

In yet another embodiment, the evaporator includes the cavity layer that includes a cavity formed between two protrusions extending inwardly from the inner surface of the at least one tube.

In yet another embodiment, the evaporator includes the two protrusions that constrict a flow of the first fluid through an opening of the cavity to promote bubbling and evaporation.

In yet another embodiment, the evaporator includes that the extended member includes a fin protruding outwardly from the exterior surface of the at least one tube, and the extended member extending along a horizontal direction of the at least one tube.

In yet another embodiment, the evaporator includes that the extended member wraps around the exterior surface of the at least one tube.

In yet another embodiment, the evaporator includes that the extended member is perpendicular to a length of the at least one tube.

In an embodiment, an HVACR system includes a refrigerant circuit including a compressor, a condenser, an expander, and an evaporator fluidly connected. The evaporator includes a shell including an internal volume; a tube bundle extending through the internal volume, at least one tube in the tube bundle having an exterior surface and an inner surface, an extended member on the exterior surface, and a cavity layer on the inner surface; a first flow path configured to direct the first fluid to flow through the tube bundle and contact the cavity layer on the inner surface of the at least one tube to evaporate the first fluid; and a second flow path, separate from the first flow path, configured to direct a second fluid across the tube bundle and to contact the extended member on the exterior surface of the at least one tube such that the first fluid exchanges thermal energy with the second fluid.

In another embodiment, the HVACR system includes that the first fluid is a working fluid, and the cavity layer is an enhanced boiling surface arranged to evaporate the first fluid flowing inside the at least one tube.

In yet another embodiment, the HVACR system includes that the cavity layer includes a cavity formed between two protrusions extending inwardly from the inner surface of the at least one tube.

In yet another embodiment, the HVACR system includes that the two protrusions constrict a flow of the first fluid through an opening of the cavity to promote bubbling and evaporation.

In yet another embodiment, the HVACR system includes that the extended member includes a fin protruding outwardly from the exterior surface of the at least one tube, and the extended member extending along a horizontal direction of the at least one tube.

In yet another embodiment, the HVACR system includes that the extended member wraps around the exterior surface of the at least one tube.

In yet another embodiment, the HVACR system includes that the extended member is perpendicular to a length of the at least one tube.

In an embodiment, a direct expansion heat exchanger tube is arranged to evaporate a working fluid inside the direct expansion heat exchanger tube. The direct expansion heat exchanger tube includes an exterior surface of the direct expansion heat exchanger tube opposing an inner surface of the direct expansion heat exchanger tube; an extended member on the exterior surface; and a cavity layer on the inner surface configured to evaporate the working fluid flowing in a first flow path arranged to direct the first fluid to flow through the direct expansion heat exchanger tube and contact the cavity layer on the inner surface, and a second flow path, separate from the first flow path, arranged to direct a second fluid across the direct expansion heat exchanger tube and to contact the extended member on the exterior surface of the direct expansion heat exchanger tube such that the first fluid exchanges thermal energy with the second fluid.

In another embodiment, the direct expansion heat exchanger tube includes that the first fluid is a working fluid, and the cavity layer is an enhanced boiling surface arranged to evaporate the first fluid flowing inside the direct expansion heat exchanger tube.

In yet another embodiment, the direct expansion heat exchanger tube includes that the cavity layer includes a cavity formed between two protrusions extending inwardly from the inner surface of the tube.

In yet another embodiment, the direct expansion heat exchanger tube includes that the two protrusions constrict a flow of the first fluid through an opening of the cavity to promote bubbling and evaporation.

In yet another embodiment, the direct expansion heat exchanger tube includes that the extended member wraps around the outside surface of the direct expansion heat exchanger tube.

In yet another embodiment, the direct expansion heat exchanger tube includes that a fin of the extended member is perpendicular to a length of the tube.

BRIEF DESCRIPTION OF THE DRAWINGS

References are made to the accompanying drawings that form a part of this disclosure, which illustrate embodiments in which features described in this specification can be practiced.

Like reference numbers represent like parts throughout.

DETAILED DESCRIPTION

Figure 1:
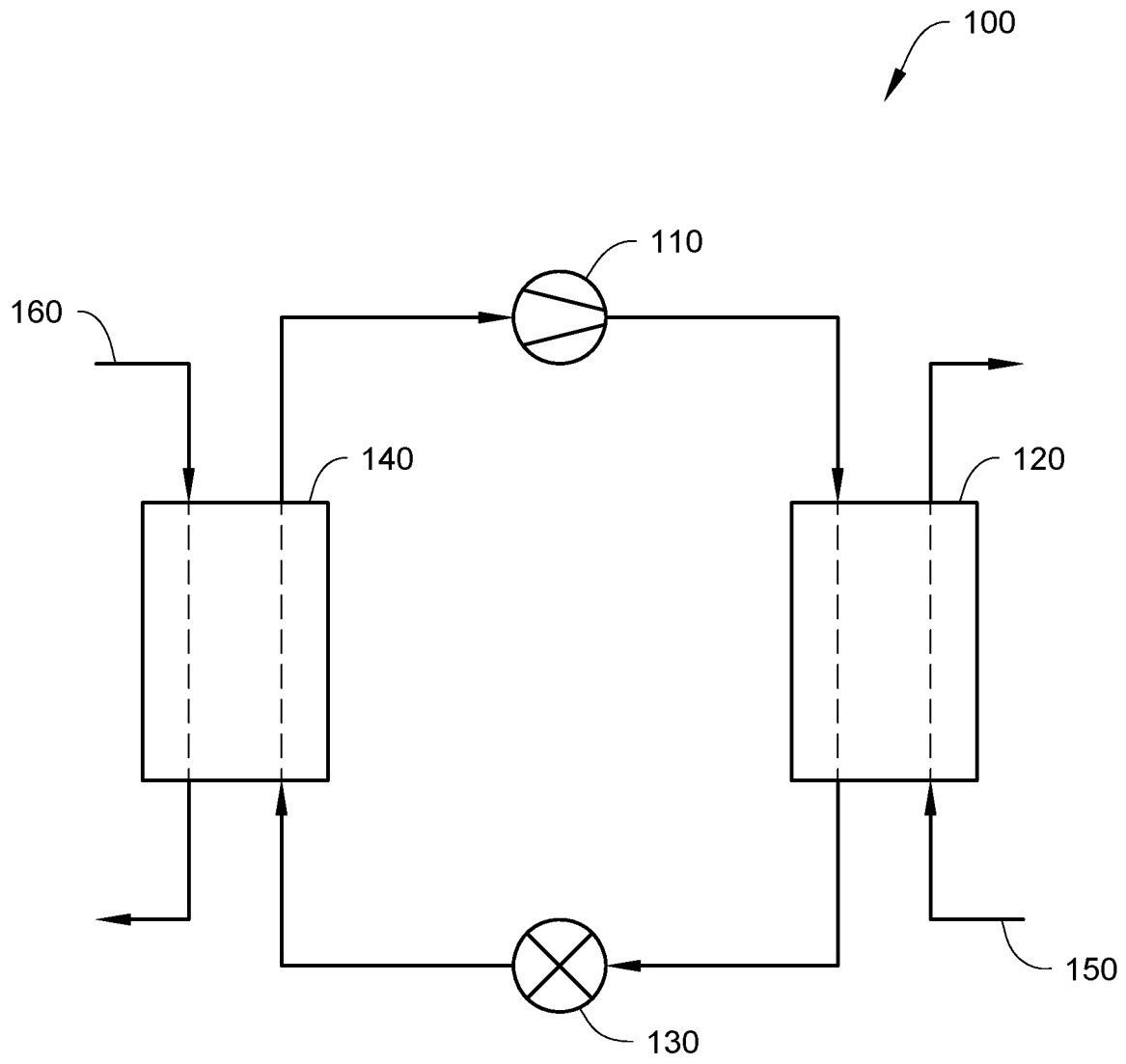
FIG. 1 is schematic diagram of an embodiment of a heat transfer circuit of an HVACR system.

A heating, ventilation, air conditioning, and refrigeration ("HVACR") system is generally configured to condition a controlled space (e.g., an interior of a commercial or residential building, an interior of a refrigerated transport unit, or the like). The HVACR system includes a heat transfer circuit having an evaporator, a compressor, a condenser, and an expander in fluid communication by a working fluid (e.g., a refrigerant, a refrigerant mixture, or the like) that circulates through the heat transfer circuit. The working fluid is utilized to heat or cool a process fluid (e.g., air, water and/or glycol, or the like). In an embodiment, an HVACR system can be chiller equipment containing an evaporator, a compressor, a condenser, and an expander in fluid communication by a working fluid (e.g., a refrigerant, a refrigerant mixture, or the like) that circulates through the heat transfer circuit. The HVACR system can be the chiller system in which the evaporator cools a liquid (e.g., water, chiller water, water/glycol mixture, or the like). The evaporator in the HVACR system or the chiller system and/or the condenser may be a shell-and-tube heat exchanger with a tube bundle having a plurality of heat exchanger tubes.

A heat transfer circuit for an HVACR system includes an evaporator, a condenser, a compressor, and an expander. The evaporator and the condenser are each a heat exchanger that heats or cools a working fluid of the heat transfer circuit with different fluids (e.g., chiller water, external water, external air, or the like). The HVACR can be a chiller system in which the working fluid in the evaporator cools water. The evaporator and/or the condenser can be a heat exchanger, such as a shell-and-tube heat exchanger. In some embodiments, the shell-and-tube heat exchanger can be a direct expansion heat exchanger having a working fluid (e.g., a refrigerant, a refrigerant mixture, or the like) evaporates inside the heat exchanger tubes of the heat exchanger in order to cool a second fluid that flows outside tubes.

Compared to a flooded type evaporator having a tube bundle submerged in the working fluid and configured to evaporate the working fluid accumulated at the bottom of the evaporator, a direct expansion heat exchanger has a working fluid flowing inside the heat exchanger tubes and being evaporated. By having the working fluid flowing and evaporating inside the heat exchanger tube, the refrigerant charge, freezing of the second fluid, and/or the complexity of recovering lubricant from the working fluid can be advantageously reduced in a direct expansion heat exchanger. In an embodiment, the inner surface of the heat exchanger tubes can include a cavity layer to promote heat transfer of the heat exchanger tube. In an embodiment, the cavity layer can be referred to as an enhanced boiling surface of a heat exchanger tube. The cavity layer can promote heat transfer by promoting evaporation of the working fluid through trapping a portion of the working fluid in the boiling layer. For example, the cavity layer can trap a portion of working fluid that, for example, hinder a flow of working fluid in and out a cavity in the cavity layer. The working fluid trapped in the cavity can be in vapor and/or liquid phase to promote bubble generation. Bubble dynamic (e.g., movement of bubbles in the working fluid) and evaporation can improve heat transfer between the tube and the working fluid, thereby increasing heat transfer efficiency of the direct expansion heat exchanger. The cavity layer can promote heat transfer, for example, by having one or more cavities with openings that connect the cavities with the interior space of the tubes. The openings trap a portion of the vapor working fluid (i.e., a vapor fraction of the working fluid) by constricting the flow of the working fluid at the opening so that the space available for the working flow flowing through the opening can be smaller than that of before and after the opening. This contraction at the opening can create a back pressure that traps the vapor fraction of the working fluid in the cavities. Liquid working fluid can flow into the cavities due to gravity, turbulence, surface tension, or the like. The size of the opening can be configured according to the fluid characteristic of the working fluid (e.g., density, viscosity, or the like).

The liquid fluid that flows into a cavity can form a liquid film of working fluid wetting the surrounding walls of the cavities. The openings of the cavities can be more constrained than the volume/space inside the cavities and at least momentarily traps the vapor working fluid in the cavities. The trapped vapor working fluid can exchange thermal energy with the tube, forms a bubble that grows and detaches from the nucleation site. The nucleation site maintains a vapor fraction that forms another bubble.

As the evaporation continues, the bubbles expand and leave the cavity via the opening and another portion of liquid working fluid flows into the cavities in order to replenish the volume previously occupied by the vapor and/or reconstitute the liquid film. The working fluid flowing in and out of the cavities can promote evaporation, for example, by inducing mixing and/or turbulence such that working fluid/refrigerant side coefficient of heat transfer can be improved over that of a prior direct expansion evaporator.

It is appreciated that, by combining the finned member on the outside of the tube guiding the flow path of the shell side and the cavity layer on the inside of the tube, the overall heat transfer can be improved compared, for example, to direct expansion heat exchangers comprising plain tubes, internally finned tubes, and/or externally finned tubes without a cavity layer on the inner surface of the tubes.

It is further appreciated that the cavities in the cavity layer on the inner surface of the heat exchanger tubes can be formed or disposed in between any suitable structures integrally formed, sprayed, etched, sintered, installed, attached, pressed onto the inner surface of the heat exchanger tube, or the like. The structures can include protruding materials, tube inserts (e.g., fold sheets, internal fins, wire mesh), or the like, to increase heat transfer or reduce resistance to heat transfer by adding nucleation sites for working fluid and/or introducing, for example, turbulence, mixing, temperature gradient, or the like.

FIG. 1 is a schematic diagram of a heat transfer circuit 100 of a HVACR system, according to an embodiment. The heat transfer circuit 100 includes a compressor 110, a condenser 120, an expansion device 130, and an evaporator 140. In an embodiment, the heat transfer circuit 100 can be modified to include additional components. For example, the heat transfer circuit 100 in an embodiment can include an economizer heat exchanger, one or more flow control devices, a receiver tank, a dryer, a suction-liquid heat exchanger, or the like.

The components of the heat transfer circuit 100 are fluidly connected (e.g., for using/directing the working fluid). The heat transfer circuit 100 can be configured as a cooling system (e.g., a chiller of an HVACR system, an air conditioning system, or the like) that can be operated in a cooling mode, and/or the heat transfer circuit 100 can be configured to operate as a heat pump system that can run in a cooling mode and a heating mode.

The heat transfer circuit 100 applies known principles of vapor compression and heat transfer using a working fluid (e.g., a refrigerant, a refrigerant mixture, or the like). The heat transfer circuit 100 can be configured to heat or cool a fluid (e.g., water, air, or the like). In an embodiment, the heat transfer circuit 100 may represent a chiller or a water chiller that chills a second fluid such as water, glycol, or the like. In an embodiment, the heat transfer circuit 100 may represent an air conditioner and/or a heat pump that cools and/or heats the second fluid such as air, water, glycol, or the like.

During the operation of the heat transfer circuit 100, a vapor stream of the working fluid at a relatively low pressure can flow into the compressor 110 from the evaporator 140. The vapor stream can be the working fluid in a vapor form or predominately vapor form. The compressor 110 compresses the vapor stream into a high pressure state having a relatively high pressure, which may also increase the temperature of the vapor stream to have a relatively high temperature. After being compressed, the vapor stream flows from the compressor 110 to the condenser 120. In addition to the vapor stream of the working fluid flowing through the condenser 120, the first process fluid 150 (e.g., external air, external water, chiller water, heat transfer fluid, or the like) also separately flows through the condenser 120. The first process fluid 150 exchanges thermal energy with the working fluid as the first process fluid 150 flows through the condenser 120, cooling the working fluid as it flows through the condenser 120. The vapor stream of the working fluid condenses to a liquid form or predominately liquid form, providing a liquid stream of the working fluid. The liquid stream of the working fluid then flows into the expansion device 130.

The expansion device 130 allows the working fluid to expand, lowering the pressure and/or temperature of the working fluid. An "expansion device" as described herein may also be referred to as an expander. In an embodiment, the expander may be an expansion valve, expansion plate, expansion vessel, orifice, or the like, or other such types of expansion mechanisms. It should be appreciated that the expander may be any type of expander used in the field of refrigeration/HVACR system for expanding a working fluid to cause the refrigerant/working fluid to decrease in temperature and pressure. The liquid, vapor stream of relatively lower pressure working fluid then flows into the evaporator 140. A second process fluid 160 (e.g., external air, external water, chiller water, heat transfer fluid, air, or the like) also flows through the evaporator 140. The working fluid exchanges thermal energy with the second process fluid 160 as it flows through the evaporator 140, cooling the second process fluid 160. As the working fluid exchanges thermal energy (e.g., absorb heat), the working fluid evaporates to a vapor, or a predominately vapor form, providing the vapor stream. The vapor stream of the working fluid then returns to the compressor 110 from the evaporator 140. In some embodiments, the heat transfer circuit 100 is configured as a cooling system (e.g., a water chiller, an air conditioner, or the like) to cool the second process fluid 160.

Figure 2:
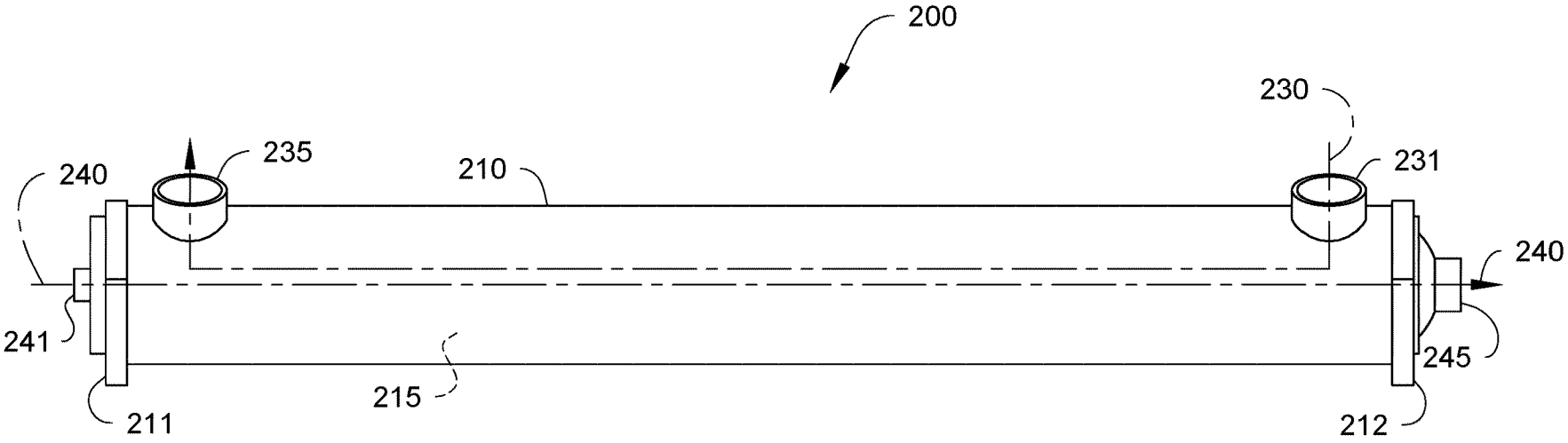
FIG. 2 is a perspective view of the heat exchanger according to an embodiment.
Figure 3:
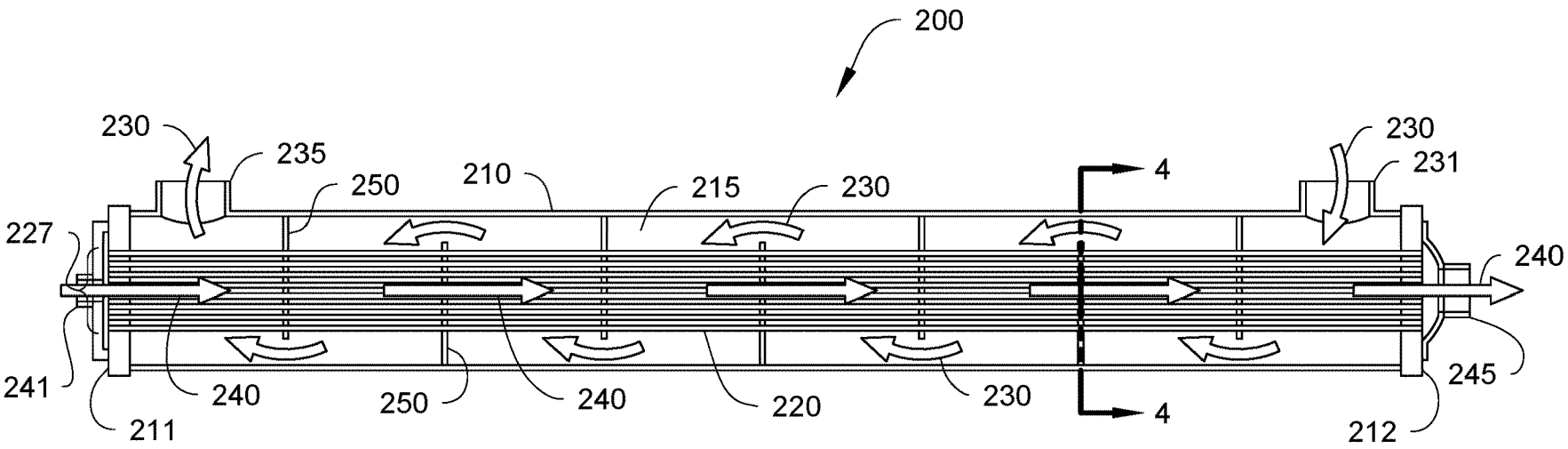
FIG. 3 is a horizontal-sectional view of the heat exchanger of FIG. 2, according to an embodiment.
Figure 4:
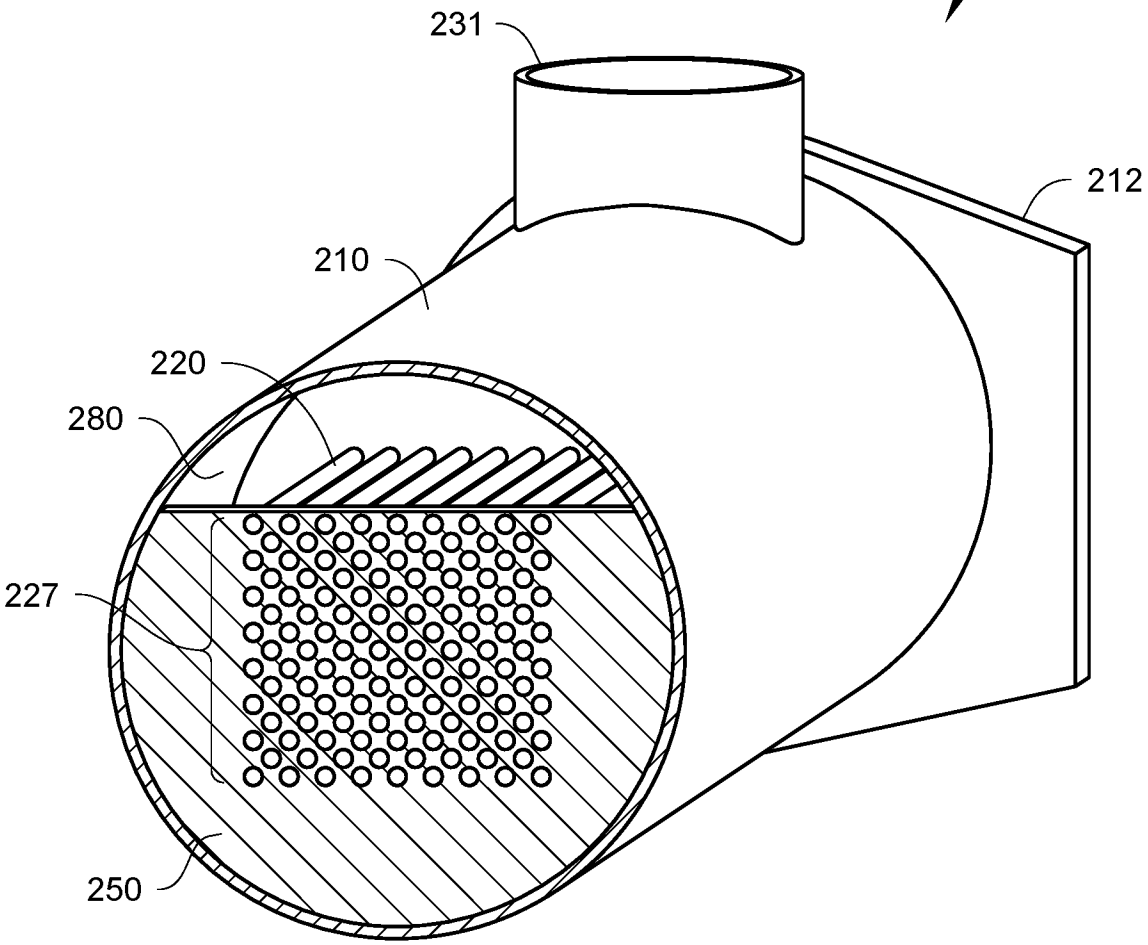
FIG. 4 is a vertical cross-sectional view of the heat exchanger of FIG. 2, according to the embodiment.

FIGS. 2-4 illustrate different views of a shell-and-tube heat exchanger 200, according to an embodiment. FIG. 2 is a perspective view of the heat exchanger 200. FIG. 3 is a horizontal cross-sectional view of the heat exchanger 200. FIG. 4 is a horizontal cross-sectional view of the heat exchanger 200 along the line 4-4 in FIG. 3. The shell-and-tube heat exchanger 200 can be an evaporator that utilizes a liquid (e.g., chiller water, water and/or glycol, or the like) as a process fluid (e.g., the evaporator 140 in FIG. 1). For example, the shell-and-tube heat exchanger 200 may be an evaporator configured to cool water in a chiller HVACR system.

Referring to FIG. 2, the shell-and-tube heat exchanger 200 is a direct expansion heat exchanger that evaporates the working fluid inside the heat exchanger tubes. The heat exchanger 200 transfers heat between the working fluid and the process fluid, which cools the process fluid and evaporates the working fluid. The working fluid and the process fluid flow through the heat exchanger 200 without physically mixing with each other. The working fluid flows through a tube side 240 of the heat exchanger 200, and the process fluid flows through the shell side 230 of the heat exchanger 200. The process fluid flowing in the shell side 230 exchanges heat with the working fluid flowing in the tube side 240, which heats the working fluid and cools the process fluid. In an embodiment, the process fluid can be the second process fluid 160 in FIG. 1.

As shown in FIG. 2, the heat exchanger 200 has a shell 210 that generally defines the shell side and heat exchanger tubes 220 (shown in FIG. 3) that generally define the tube side 240. The shell 210 includes an internal volume 215. The internal volume 215 is contained within the shell 210 and disposed between a first end cap 211 and a second end cap 212. The heat exchanger tubes 220 extend through the internal volume 215 of the heat exchanger 200 and separate the shell side 230 from the tube side 240 (e.g., the walls of the heat exchanger tubes 220 separate the shell side 230 from the tube side 240). The shell side inlet 231, the shell side outlet 235, the tube side inlet 241, and the tube side outlet 245 are disposed on the shell 210 of the heat exchanger 200. In an embodiment, the tube side inlet 241 and the tube side outlet 245 are disposed on the end caps 211, 212 respectively.

As shown in FIG. 3, the heat exchanger tubes 220 are stacked inside the shell 210 to form a heat exchanger tube bundle 227. The heat exchanger tube bundle 227 is supported within the heat exchanger 200. The heat exchanger tube bundle 227 can be supported by, for example, one or more tube supports 250 as shown in FIG. 3. The heat exchanger tube bundle 227 can include the heat exchanger tubes 220. At least one of the heat exchanger tubes 220 can be an elongated tube having an inner surface and an exterior surface. The working fluid can flow through the heat exchanger tube 220 and contact the inner surface to exchange thermal energy with the heat exchanger tube 220 and the process fluid flowing in the shell side 230. In some embodiments, the working fluid can flow in the tube side 240 while evaporating at the inner surface to cool the heat exchanger tube 220 and the process fluid.

The shell side 230 can be a flow path connecting the shell side inlet 231 and the shell side outlet 235. The flow path of the shell side 230 is configured to direct the process fluid through the internal volume 215 across the tube bundle 227, for example, between and around the heat exchanger tubes 220 of the tube bundle 227. The tube support 250 supports the tubes 220 and/or function as baffle(s) to direct the flow path of the shell side 230. For example, as shown in FIG. 4, the tube support 250 provides an axial opening 280 above the tube bundle 227.

As shown in FIG. 3, the tube support 250 can alternatively provide the axial openings 280 above and below the tube bundle 227 such that the flow path of the shell side 230 extends at or about perpendicular to the axial direction of the heat exchanger 200 while moving in the axial direction of the heat exchanger 200.

The process fluid flows through the shell side 230 to contact the exterior surface of the tubes 220 and to exchange thermal energy with the working fluid flowing in the heat exchanger tubes 220. As the process fluid flows through the shell side 230, the process fluid is cooled from a relatively higher temperature at the shell side inlet 231 to a relatively lower temperature at the shell side outlet 235 (i.e., from a first temperature at the shell side inlet 231 to a lower temperature at the shell side outlet 235).

The tube side 240 is a flow path that connects the tube side inlet 241 and the tube side outlet 245 and is fluidly separate from the flow path of the shell side 230. In the cooling mode, the working fluid flows through the tube side 240 of the heat exchanger 200 to exchange thermal energy with the process fluid and evaporate the process fluid within the heat exchanger tubes 220. The flow path of the tube side 240 directs the working fluid to flow through the interior of the tubes 220 of the tube bundle 227 such that the working fluid contacts the inner surface of the tubes 220. One or more of the tubes 200 has a cavity layer on the inner surface of the tube 200. The working fluid at the tube side inlet 241 can be in a liquid-vapor (e.g. two-phase) form. In an embodiment, the working fluid at the tube side inlet 241 is in a form that includes liquid working fluid with entrained working fluid in vapor and/or bubbles from, for example, expansion due to an expansion device (e.g., the expansion device 130 in FIG. 1). The working fluid evaporates and expands while flowing through the tube side 240 (e.g., from left to right in FIG. 3). The working fluid at the tube side outlet 245 can be a vapor. In an embodiment, the working fluid at the tube side outlet 245 may be a superheated vapor such that the working fluid has a temperature above its saturation temperature.

Figure 5:
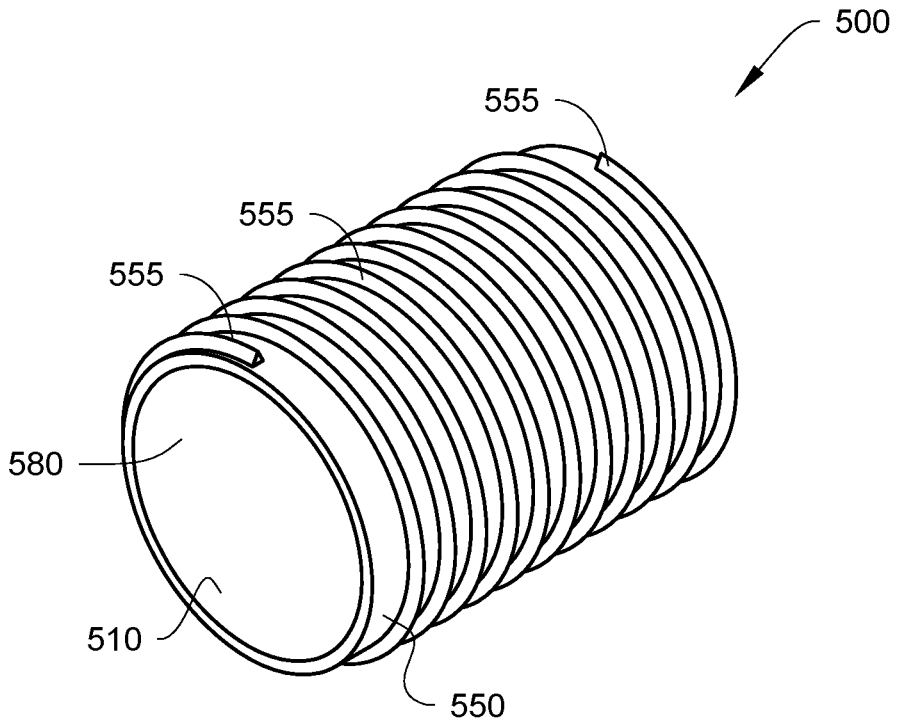
FIG. 5 is a perspective view of a tube segment according to an embodiment.
Figure 6:
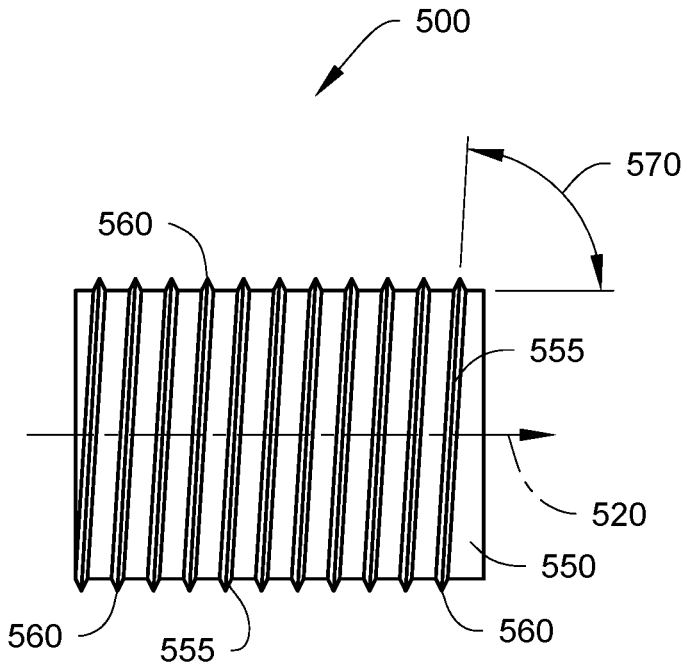
FIG. 6 is a horizontal side view of the tube segment of FIG. 5, according to the embodiment.

FIGS. 5 and 6 are views of a tube segment of a heat exchanger tube in a tube bundle according to an embodiment. FIG. 5 is a perspective view of the tube segment 500 according to an embodiment. FIG. 6 is a horizontal side view of the tube segment 500 according to an embodiment. The tube segment 500 can be a segment of one of the heat exchanger tubes 220 in FIGS. 2-4. It is appreciated that features described for the tube segment 500 may apply to the full length of a heat exchanger tube, a portion of the entire length of a heat exchange, multiple separate portions of the heat exchanger tube, and the like. In some embodiments, the tube segment 500 that repeats to form the full length, or a portion of the full length, of a heat exchanger tube can be referred to as tube 500.

As shown in FIG. 5, the tube 500 includes an inner surface 510 and an exterior surface 550. The inner surface 510 encloses an internal space 580 of the tube 500. In an embodiment, the inner surface 510 can be cylindrical. In some embodiments, a cross-sectional area of the inner surface 510 can have a boundary of any shape suitable for facilitating heat transfer between the working fluid and the process fluid. For example, the cross-sectional shape can be a circle, oval, hexagon, rectangular, triangle, or the like, or a combination thereof.

The internal space 580 is a portion of the flow path of the tube side (e.g., tube side 240 in FIGS. 2-4). The working fluid is arranged to flow through the internal space 580 of the tube 500 and contact the inner surface 510 of the tube 500. The inner surface 510 includes a cavity layer configured to provide an enhanced boiling surface that promote heat transfer of the tube through promote evaporation and bubble formation of evaporated working fluid vapor. In an embodiment, the cavity layer can be referred to as an enhanced boiling surface on the inner surface of the heat exchanger tube. The cavity layer can trap a flow of the working fluid. The cavity layer enhances and promotes heat transfer between the working fluid, the tube 500, and the process fluid in contact with the exterior surface 550 of the tube 500.

It is appreciated that the cavity layer trapping working fluid can increase heat transfer of the heat exchanger tube by increasing heat transfer area which increase liquid contact between the working fluid and the inner surface 510 of the tube 500 to increase heat transfer over a tube having smooth or finned inner surface. It is further appreciated that the cavities in the cavity layer can promote bubble formation and/or detachment from the cavity layer that improves heat transfer by bubble dynamic, creating convective heat transfer, such as agitation, mixing, or the like. The cavity in the cavity layer can encourage heat transfer by promote evaporation (i.e., latent heat transfer) through promoting the formation of evaporated vapor bubbles and/or selectively providing nucleation sites for bubble formation. The cavity layer on the inner surface 510 can be, but is not limited to, integrally formed structures (e.g., ribs, protrusions, or the like), a texture, sprayed on features, attached or pressed into the inner surface 510, and the like. The cavity layer and experimental data are discussed in more detail below with respect to FIGS. 7-11.

As shown in FIG. 6, the exterior surface 550 includes at least one extended member 560. In an embodiment, the extended member 569 can be a finned member having one or more fins 555 on the exterior surface 550 of the tube 500. The fins 555 can protrude outwardly from the exterior surface 550 of the tube 500. In an embodiment, the fins 555 may protrude radially, helically, or axially outward such that an angle 570 between a respective fin 555 and a horizontal direction 520 of the tube 500. At least one of the fins 555 can be any suitable degree for example, to promote turbulence, increase heat transfer area, reduce boundary layer effects, to promote heat transfer between the working fluid, the tube 500, and the second fluid (e.g., the process fluid flowing in the shell side of a heat exchanger). The finned member 560 can wrap around or extend from the exterior surface 550 of the tube 500 along at least a portion of the overall length of the tube 500. In an embodiment, the fins 555 of the finned member 560 may be provided on the exterior surface 550 of the tube by being welded, installed, attached, integrally formed on the exterior surface 550 of the tube 500, or the like.

In an embodiment, the working fluid flows with, or against, the horizontal direction 520 in the internal space 580 (as shown in FIG. 5) of the tube. The process fluid flows perpendicular to the horizontal direction 520 outside the tube 500 and contacts the exterior surface 550 of the tube 500.

Figure 7:
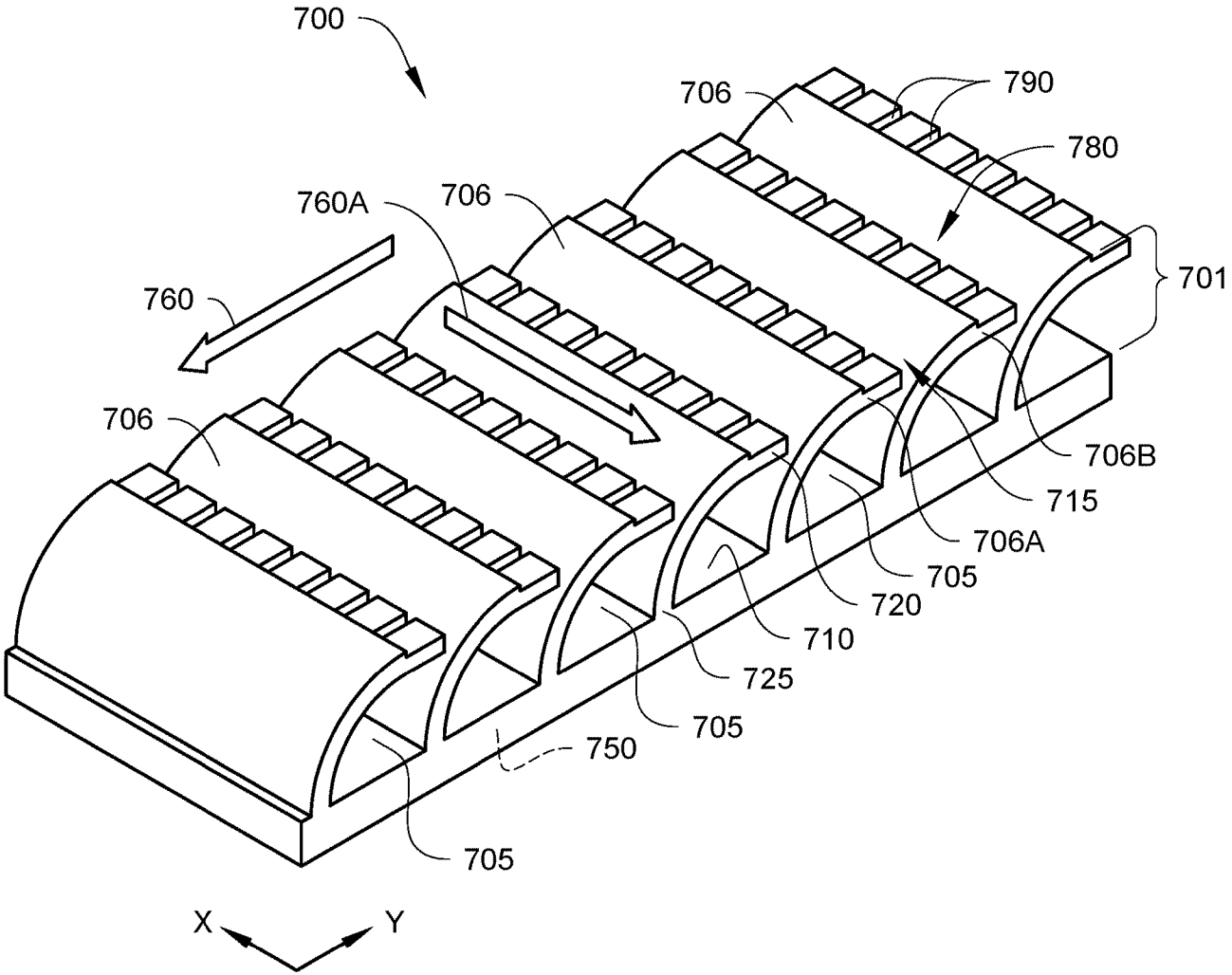
FIG. 7 is a perspective view of a segment of a cavity layer on a tube, according to an embodiment.

FIG. 7 is a perspective view of a segment 700 of a cavity layer 701 for the tube, according to an embodiment. In an embodiment, the cavity layer 701 can be the cavity layer on the inner surface 510 of the tube 500 in FIG. 5. In such an embodiment, the surface 710 represents the inner surface 510 of the tube 500 of FIG. 5. Accordingly, the surface 710 can be referred to as an inner surface of a heat exchanger tube, and the surface 750 can be referred to as an exterior surface of the heat exchanger tube.

The view of FIG. 7 is flattened to illustrate the structures of the cavity layer 701 and with the finned member (e.g. 560 of FIGS. 5 and 6) omitted. A tube (e.g., tube 220 of FIGS. 2-4) can include one or more segments 700 extended and/or repeated in the X and/or Y directions and curled/wrapped along the X direction, Y direction, or a direction in-between, into a tubular shape to form a tube (e.g., tube 220 of FIGS. 2-4). When formed into a tubular shape to make a tube, the features on surface 710 can be disposed on the inner surface and the opposite surface 750 can be disposed on the exterior surface of the formed tube. In some embodiments, the tubular shape can have a circular, oval, hexagonal, rectangular, triangular cross-sectional shape, or a combination thereof.

As shown in FIG. 7, the segment 700 illustrates a cavity layer 701 disposed on the inner surface 710. In an embodiment, the cavity layer 701 provides an enhanced boiling surface for the tube formed by the segment 700. A tube formed by the segment 700 can have an internal space (e.g., internal space 580 of FIG. 5).

The cavity layer 701 includes a plurality of protrusions 706 that extend into the internal space of the formed tube. One or more cavities 705 are disposed in the cavity layer 701 above the inner surface 710. As shown in FIG. 7, the one or more cavities 705 are disposed between the pluralities of protrusions 706 extending into the internal space of the formed tube. Each cavity 705 is disposed between a respective pair of the protrusions 706. Working fluid (e.g., illustrated as arrow 760 or 760A) can flow in the interior space 780 of the formed tube in the tube side. In an embodiment, the interior space 780 can be the interior space 580 of FIG. 5.

The cavities 705 are pockets in the internal space and/or the cavity layer 710 of the tube in which at least a portion of the working fluid is arranged to flow into the cavities 705 to be evaporated. The portion of the working fluid can be evaporated to create vapor and/or bubbles. The portion of the working fluid enters the cavities 705 and leave as vapor or bubbles via an opening 715 of the cavity 705 disposed between two adjacent protrusions 706A and 706B.

As shown in FIG. 7, the protrusion 706 includes a first end 720 and a second end 725. The first end 720 extends inwardly towards the internal space of the formed tube away from the second end 725 that is attached to the inner surface 710. In an embodiment, the first end 720 of at least one protrusion 706 can include at least one notch 790 in the first end 720. The notch 790 can be an opening in the protrusion 706 to allow fluid communication through the first end 720 of the protrusion 706. The opening provided by the notch 790 can connect to the opening 715 disposed between the protrusions 706. In an embodiment, the opening 715 can include the opening created by the notch 790.

In some embodiments, the protrusions 706 are each bent such that the first end 720 also extends along the y-axis. For example, each of the protrusions 706 extends from the inner surface 710 and has a curved shape in the same direction (e.g., along the y-axis in FIG. 7). The working fluid can flow in and out the cavities to be evaporated. The influx and out flow of working fluid can occur in alternative flow pattern and/or simultaneously. For example, the working fluid is trapped in the cavities 705 until evaporating. More specifically, the cavities 705 are configured to trap a liquid portion of the working fluid in the cavities until said liquid portion evaporates. The evaporated working fluid then escapes from the cavities 705. The pockets formed by the cavities 705 can induce mixing and/or turbulence such that working fluid/refrigerant side coefficient of heat transfer can be improved over prior direct expansion evaporators. In an embodiment, a liquid portion of working fluid is flowing into the cavities 705 to be evaporated while, simultaneously, an earlier portion of liquid working fluid, that has now been evaporated to provide an evaporated portion of working fluid, is flowing out of the cavities 705.

In some embodiments, the protrusions 706 in the cavity layer 710 can increase the surface area for exchanging thermal energy compared, for example, to a bare inner surface or naturally occurring surface imperfections, and other surface enhancements that do not form cavities. As shown in FIG. 7, the working fluid is illustrated to flow opposite to a direction of the y-axis as illustrated by arrow 760. However, it is appreciated that the working fluid can flow with, or against, the direction of arrow 760, 760A, or a combination thereof such that the directions of working fluid flow can be arranged in the x-axis, the y-axis, or a combination thereof (e.g., a direction in-between the x-axis and the y-axis).

It is appreciated that, in an embodiment of forming a tube by wrapping the illustrated segment 700 around the x-axis such that the length of the formed tube is in the direction of the x-axis; and the working fluid flows with or against the direction indicated by arrow 760A and inside the formed tube. In an embodiment of forming a tube by wrapping the illustrated segment 700 around the y-axis, the working fluid flows with or against the direction indicated by the arrow 760. In an embodiment of forming a tube by wrapping the illustrated segment 700 around a direction between the x and y-axis (e.g., 30 or 45 degrees from the x-axis towards the y-axis), the working fluid flows in the direction of the direction between the x and y-axis.

Figure 8:
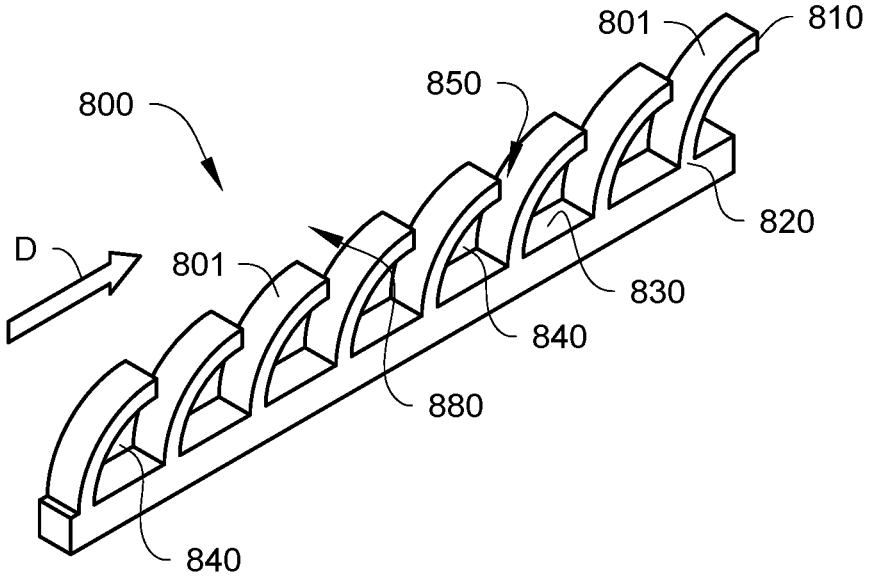
FIG. 8 illustrates a vertical cross-section of an embodiment of a cavity layer.
Figure 9:
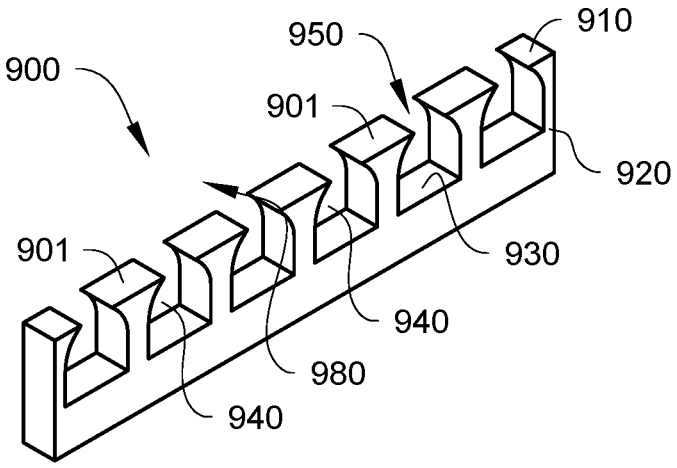
FIG. 9 illustrates a vertical cross-section of an embodiment of a cavity layer.
Figure 10:
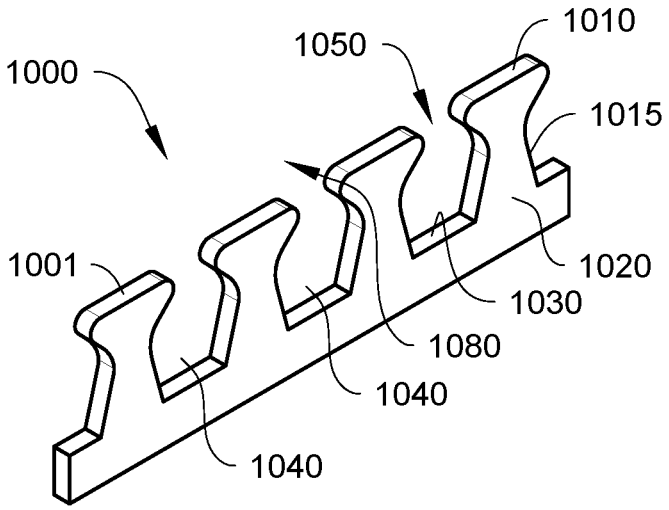
FIG. 10 illustrates a vertical cross-section of an embodiment of a cavity layer.

FIGS. 8-10 illustrate embodiments of protrusions for a cavity layer. FIGS. 8-10 can be a slice of the tube having the cavity layer and/or the enhanced boiling surface illustrated to show the protrusions that forms cavities in the cavity layer on the inner surface of the heat exchanger tube. The cavity layer can provide to provide the enhanced boiling surface. For example, the slice shown in FIG. 8 can be a section or slice of the segment 700 taken in the x-axis of FIG. 7. In an embodiment, the slice can be extended for 360 degrees relative to, and/or extending 360 degrees to wrap around, a centerline to make a tube. As discussed with respect to FIG. 7, the tube can be formed such that the working fluid can flow in any direction suitable for heat transfer. As shown in FIG. 8-10, the working fluid can similarly flow in any direction and is not limited to the direction D.

It is appreciated that the cavity layer and/or the enhanced boiling surface can promote evaporation of the working fluid by trapping at least a vapor portion of the working fluid into the cavities formed in the cavity layer. The vapor working fluid is momentarily trapped behind a pinch point (e.g., 850, 950, and/or 1050 as shown in FIGS. 8-10) and evaporated within the cavities. Vapor bubbles are formed in the cavity and leaving the cavity while the working fluid continues to flow into the cavity and keeps the walls surround the cavities wet, for example, with the liquid working fluid. The working fluid entering and leaving the cavities can also be inducing turbulence, creating a larger heat transfer area, promoting mixing, and/or the like to increase the coefficient of heat transfer on the working fluid side (e.g., tube side) of the heat exchanger (e.g., heat exchanger 200 in FIG. 2).

As shown in FIG. 8, a slice 800 includes a plurality of protrusions 801. Each of the protrusions 801 can include a first end 810 and a second end 820. The first end 810 can be an end of the protrusion 801 that extends into the internal space 880 of the formed tube. In an embodiment, the internal space 880 can be the internal space 580 of FIG. 5. The second end 820 can be the end of the protrusion 801 that is attached to an inner surface 830 of the formed tube. Cavities 840 are disposed between the protrusions 801 to evaporate the working fluid flowing inside the formed tube. In some embodiments, the first end 810 of the protrusions 801 can bend or fold in an axial direction D of the formed tube to promote heat transfer (e.g., axial direction D being a direction parallel to the axis of the tube).

It is appreciated that working fluid flowing into the cavity 840 can flow through an opening for the cavity 840. The opening creates a pinch point 850 for fluid flow between the first end 810 of a protrusion 801 and an adjacent protrusion 801, for example, due to the bend. The pinch point 850 can allow the cavity 840, thereby the cavity layer or the enhanced boiling surface, to trap working fluid into the cavities 840 for promoting evaporation and enhance heat transfer. In particular, a liquid portion of the working fluid flows through the pinch point 850 and is evaporated within the cavity 840. The pinch point 850 can be any suitable restriction with a clearance between, for example, the first end 810 of a protrusion 801 to the adjacent protrusion 801 in order to trap a liquid portion of the working fluid in the cavities 840. The clearance can be selected according to the fluid characteristic of the working fluid (e.g., density, viscosity, or the like). For example, a working fluid with higher viscosity may require a larger clearance, a working fluid with higher density may require a smaller clearance, and the like.

As shown in FIG. 9, a slice 900 includes a plurality of protrusions 901. Each of the protrusions 901 can include a first end 910 and a second end 920. The first end 910 is an end of the protrusion 901 that extends into an internal space 980 of the formed tube. In an embodiment, the internal space 980 can be the internal space 580 of FIG. 5. The second end 920 is the end of the protrusion 901 attached to an inner surface 930 of the formed tube. Cavities 940 are disposed between the protrusions 901 to evaporate the working fluid flowing inside the formed tube. The cavities 940 are formed by the protrusions 901. As show in FIG. 9, the first end 910 of the protrusions 901 can be wider than that of the second end 920 such that the spacing between the first ends 910 are smaller than the spacing at the second ends 920 to promote heat transfer, for example, by trapping working fluid behind a pinch point 950. The wider first ends 910 of the protrusions 901 forming the pinch point 950 between adjacent protrusions 901.

As shown in FIG. 10, a slice 1000 includes a plurality of protrusions 1001. Each of the protrusions 1001 includes a first end 1010 and a second end 1020. An intermediate section 1015 can be disposed between the first end 1010 and the second end 1020. The first end 1010 is end of the protrusion 1001 that extends into an internal space 1080 of the formed tube. In an embodiment, the internal space 1080 can be the internal space 580 of FIG. 5. The second end 1020 is the end of the protrusion 1001 that is attached to an inner surface 1030 of the formed tube. Cavities 1040 are disposed between the protrusions 1001 to evaporate the working fluid flowing inside the formed tube. As shown in FIG. 10, the first end 1010 and the second end 1020 of the protrusions 1001 are wider or broader than that of the intermediate section 1015 such that the spacing between the first ends 1010 are smaller than the spacing between the intermediate sections 1015. The intermediate section 1015 can be disposed between the first end 1010 and the second end 1020 to create the cavities 1040 and to promote heat transfer, for example, by trapping working fluid behind a pinch point 1050.

Figure 11:
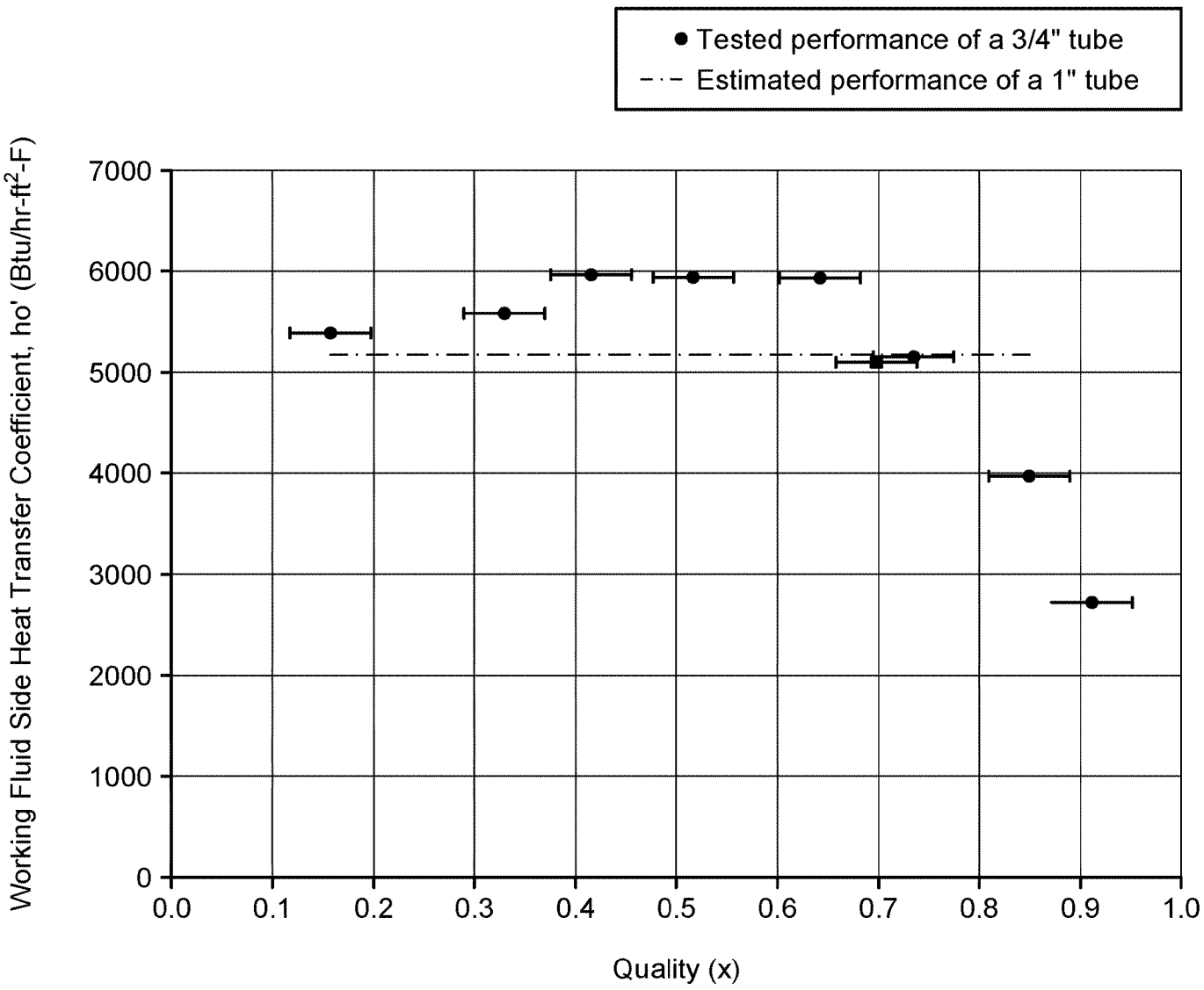
FIG. 11 is a chart showing the heat transfer coefficient in a heat transfer tube having of a tube bundle of a heat exchanger, according to an embodiment.

FIG. 11 is a chart of coefficient of heat transfer of a heat transfer tube having a cavity layer of FIG. 7, according to some embodiments. As shown in FIG. 11, a refrigerant/working fluid side heat transfer coefficient is plotted against the refrigerant thermodynamic quality in the tube bundle of a direct expansion heat exchanger (e.g., 200 of FIG. 2). The working fluid with a high linear velocity can still provide sufficient thermal performance (e.g., coefficient of heat transfers above a predetermined value). For a tested performance of a ¾-inch diameter and an estimated performance of a 1-inch diameter heat exchanger tubes having a cavity layer of FIG. 7, the transfer coefficient on the working fluid side (i.e., inner surface of the heat transfer tubes) can achieve around 5000 Btu/hr-ft$^2$-F with refrigerant quality (e.g., weight percentage of vapor in a refrigerant stream) of up to about 0.7 or 0.8. This heat transfer coefficient of around 5000 Btu/hr-ft$^2$-F is significantly higher than the transfer coefficient on the working fluid side of around 2400-2500 Btu/hr-ft$^2$-F in prior heat exchanger tubes having comparable operating conditions.

Aspects:

Any one of Aspects 1-7 may be combined with any one of Aspects 8-20. Any one of Aspects 8-14 may be combined with any one of Aspects 15-20. Any one of Aspects 2-4 may be combined with Any one of Aspects 21 or 22. Any one of Aspects 2-7 may be combined with any one of Aspects 21 or 22. Any one of Aspects 9-14 may be combined with any one of Aspects 23 or 24.

Aspect 1. An evaporator for a refrigerant circuit, comprising:

a shell including an internal volume;

a tube bundle extending through the internal volume, at least one tube in the tube bundle having an exterior surface and an inner surface, an extended member on the exterior surface, and a cavity layer on the inner surface;

a first flow path configured to direct the first fluid to flow through the tube bundle and contact the cavity layer on the inner surface of the at least one tube to evaporate the first fluid; and a second flow path, separate from the first flow path, configured to direct a second fluid across the tube bundle and to contact the extended member on the exterior surface of the at least one tube such that the first fluid exchanges thermal energy with the second fluid.

Aspect 2. The evaporator of aspect 1, wherein the first fluid is a working fluid, and the cavity layer is an enhanced boiling surface arranged to evaporate the first fluid flowing inside the at least one tube.

Aspect 3. The evaporator of aspect 1 or 2, wherein the cavity layer includes a cavity formed between two protrusions extending inwardly from the inner surface of the at least one tube.

Aspect 4. The evaporator of aspect 3, wherein the two protrusions constrict a flow of the first fluid through an opening of the cavity to promote bubbling and evaporation.

Aspect 5. The evaporator of any one of aspects 1-4, wherein the extended member includes a fin protruding outwardly from the exterior surface of the at least one tube, and the extended member extending along a horizontal direction of the at least one tube.

Aspect 6. The evaporator of any one of aspects 1-5, wherein the extended member wraps around the exterior surface of the at least one tube.

Aspect 7. The evaporator of any one of aspects 1-6, wherein the extended member is perpendicular to a length of the at least one tube.

Aspect 8. An HVACR system, comprising, a refrigerant circuit including a compressor, a condenser, an expander, and an evaporator fluidly connected, the evaporator including:

a shell including an internal volume;

a tube bundle extending through the internal volume, at least one tube in the tube bundle having an exterior surface and an inner surface, an extended member on the exterior surface, and a cavity layer on the inner surface;

a first flow path configured to direct the first fluid to flow through the tube bundle and contact the cavity layer on the inner surface of the at least one tube to evaporate the first fluid; and a second flow path, separate from the first flow path, configured to direct a second fluid across the tube bundle and to contact the extended member on the exterior surface of the at least one tube such that the first fluid exchanges thermal energy with the second fluid.

Aspect 9. The HVACR system of aspect 8, wherein the first fluid is a working fluid, and the cavity layer is an enhanced boiling surface arranged to evaporate the first fluid flowing inside the at least one tube.

Aspect 10. The HVACR system of aspect 8 or 9, wherein the cavity layer includes a cavity formed between two protrusions extending inwardly from the inner surface of the at least one tube.

Aspect 11. The HVACR system of aspect 10, wherein the two protrusions constrict a flow of the first fluid through an opening of the cavity to promote bubbling and evaporation.

Aspect 12. The HVACR system of any one of aspects 8-11, wherein the extended member includes a fin protruding outwardly from the exterior surface of the at least one tube, and the extended member extending along a horizontal direction of the at least one tube.

Aspect 13. The HVACR system of any one of aspects 8-12, wherein the extended member wraps around the exterior surface of the at least one tube.

Aspect 14. The HVACR system of any one of aspects 8-13, wherein the extended member is perpendicular to a length of the at least one tube.

Aspect 15. A direct expansion heat exchanger tube arranged to evaporate a working fluid inside the direct expansion heat exchanger tube, the direct expansion heat exchanger tube comprising:

an exterior surface of the direct expansion heat exchanger tube opposing an inner surface of the direct expansion heat exchanger tube;

an extended member on the exterior surface; and a cavity layer on the inner surface configured to evaporate the working fluid flowing in a first flow path arranged to direct the first fluid to flow through the direct expansion heat exchanger tube and contact the cavity layer on the inner surface, and a second flow path, separate from the first flow path, arranged to direct a second fluid across the direct expansion heat exchanger tube and to contact the extended member on the exterior surface of the direct expansion heat exchanger tube such that the first fluid exchanges thermal energy with the second fluid.

Aspect 16. The direct expansion heat exchanger tube of aspect 15, wherein the cavity layer is an enhanced boiling surface arranged to evaporate the first fluid flowing inside the direct expansion heat exchanger tube.

Aspect 17. The direct expansion heat exchanger tube of aspect 15 or 16, wherein the cavity layer includes a cavity formed between two protrusions extending inwardly from the inner surface of the tube.

Aspect 18. The direct expansion heat exchanger tube of aspect 17, wherein the two protrusions constrict a flow of the first fluid through an opening of the cavity to promote bubbling and evaporation.

Aspect 19. The direct expansion heat exchanger tube of any one of aspects 15-18, wherein the extended member wraps around the outside surface of the direct expansion heat exchanger tube.

Aspect 20. The direct expansion heat exchanger tube of any one of aspects 15-19, wherein a fin of the extended member is perpendicular to a length of the tube.

Aspect 21. An evaporator for a refrigerant circuit, comprising:

a shell including an internal volume;

a tube bundle extending through the internal volume, at least one tube in the tube bundle having an exterior surface and an inner surface and a cavity layer on the inner surface;

a first flow path configured to direct the first fluid to flow through the tube bundle and contact the cavity layer on the inner surface of the at least one tube to evaporate the first fluid; and a second flow path, separate from the first flow path, configured to direct a second fluid across the tube bundle and to contact the exterior surface of the at least one tube such that the first fluid exchanges thermal energy with the second fluid.

Aspect 22. The evaporator of aspect 21, wherein the at least one tube includes an extended member on the exterior surface, and the second fluid contacts the extended member on the exterior surface.

Aspect 23. An HVACR system, comprising, a refrigerant circuit including a compressor, a condenser, an expander, and an evaporator fluidly connected, the evaporator including:

a shell including an internal volume;

a tube bundle extending through the internal volume, at least one tube in the tube bundle having an exterior surface and an inner surface and a cavity layer on the inner surface;

a first flow path configured to direct the first fluid to flow through the tube bundle and contact the cavity layer on the inner surface of the at least one tube to evaporate the first fluid; and a second flow path, separate from the first flow path, configured to direct a second fluid across the tube bundle and to contact the exterior surface of the at least one tube such that the first fluid exchanges thermal energy with the second fluid.

Aspect 24. The HVACR system of aspect 23, wherein the at least one tube includes an extended member on the exterior surface, and the second fluid contacts the extended member on the exterior surface.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. An evaporator for a refrigerant circuit, comprising:

a shell including an internal volume;

a tube bundle extending through the internal volume, at least one tube in the tube bundle having an exterior surface and an inner surface and a cavity layer on the inner surface, wherein the cavity layer includes a cavity formed between two protrusions extending inwardly from the inner surface of the at least one tube, and at least one of the two protrusions being curved in an axial direction of the at least one tube;

a first flow path configured to direct a first fluid to flow through the tube bundle and contact the cavity layer on the inner surface of the at least one tube to evaporate the first fluid; and a second flow path, separate from the first flow path, configured to direct a second fluid across the tube bundle and to contact the exterior surface of the at least one tube such that the first fluid exchanges thermal energy with the second fluid.

2. The evaporator of claim 1, wherein the first fluid is a working fluid, and the cavity layer is an enhanced boiling surface arranged to evaporate the first fluid flowing inside the at least one tube.

3. The evaporator of claim 1, wherein the two protrusions constrict a flow of the first fluid through an opening of the cavity to promote bubbling and evaporation.

4. The evaporator of claim 1, wherein the at least one tube includes an extended member on the exterior surface, and the second fluid contacts the extended member on the exterior surface.

5. The evaporator of claim 4, wherein the extended member includes a fin protruding outwardly from the exterior surface of the at least one tube, and the extended member extending along a horizontal direction of the at least one tube.

6. The evaporator of claim 4, wherein the extended member wraps around the exterior surface of the at least one tube.

7. The evaporator of claim 4, wherein the extended member is perpendicular to a length of the at least one tube.

8. A heating, ventilation, air conditioning, and/or refrigeration (HVACR) system, comprising, a refrigerant circuit including a compressor, a condenser, an expander, and an evaporator fluidly connected, the evaporator including:

a shell including an internal volume;

a tube bundle extending through the internal volume, at least one tube in the tube bundle having an exterior surface and an inner surface and a cavity layer on the inner surface, wherein the cavity layer includes a cavity formed between two protrusions extending inwardly from the inner surface of the at least one tube, and at least one of the two protrusions being curved in an axial direction of the at least one tube;

a first flow path configured to direct a first fluid to flow through the tube bundle and contact the cavity layer on the inner surface of the at least one tube to evaporate the first fluid; and a second flow path, separate from the first flow path, configured to direct a second fluid across the tube bundle and to contact the exterior surface of the at least one tube such that the first fluid exchanges thermal energy with the second fluid.

9. The HVACR system of claim 8, wherein the first fluid is a working fluid, and the cavity layer is an enhanced boiling surface arranged to evaporate the first fluid flowing inside the at least one tube.

10. The HVACR system of claim 8, wherein the two protrusions constrict a flow of the first fluid through an opening of the cavity to promote bubbling and evaporation.

11. The HVACR system of claim 9, wherein the at least one tube includes an extended member on the exterior surface, and the second fluid contacts the extended member on the exterior surface.

12. The HVACR system of claim 11, wherein the extended member includes a fin protruding outwardly from the exterior surface of the at least one tube, and the extended member extending along a horizontal direction of the at least one tube.

13. The HVACR system of claim 11, wherein the extended member wraps around the exterior surface of the at least one tube.

14. The HVACR system of claim 11, wherein the extended member is perpendicular to a length of the at least one tube.

15. A direct expansion heat exchanger tube arranged to evaporate a working fluid inside the direct expansion heat exchanger tube, the direct expansion heat exchanger tube comprising:

an exterior surface of the direct expansion heat exchanger tube opposing an inner surface of the direct expansion heat exchanger tube;

an extended member on the exterior surface; and a cavity layer on the inner surface, wherein the cavity layer includes a cavity formed between two protrusions extending inwardly from the inner surface of the direct expansion heat exchanger tube, and at least one of the two protrusions being curved in an axial direction of the direct expansion heat exchanger tube, wherein the cavity layer is configured to evaporate the working fluid flowing in a first flow path arranged to direct a first fluid to flow through the direct expansion heat exchanger tube and contact the cavity layer on the inner surface; and a second flow path, separate from the first flow path, arranged to direct a second fluid across the direct expansion heat exchanger tube and to contact the extended member on the exterior surface of the direct expansion heat exchanger tube such that the first fluid exchanges thermal energy with the second fluid.

16. The direct expansion heat exchanger tube of claim 15, wherein the cavity layer is an enhanced boiling surface arranged to evaporate the first fluid flowing inside the direct expansion heat exchanger tube.

17. The direct expansion heat exchanger tube of claim 15, wherein the cavity layer includes a cavity formed between two protrusions extending inwardly from the inner surface of the direct expansion heat exchanger tube.

18. The direct expansion heat exchanger tube of claim 15, wherein the extended member wraps around the exterior surface of the direct expansion heat exchanger tube.

* * * * *